US008728188B2

(12) United States Patent
Kim et al.

(10) Patent No.: US 8,728,188 B2
(45) Date of Patent: May 20, 2014

(54) DUST-COLLECTING APPARATUS WITH A PACKING MEMBER

(75) Inventors: Tak Soo Kim, Gwangju (KR); Keon Soo Choi, Gwangju (KR); Young Jun Cho, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 246 days.

(21) Appl. No.: 13/320,061

(22) PCT Filed: Feb. 9, 2010

(86) PCT No.: PCT/KR2010/000804

§ 371 (c)(1),
(2), (4) Date: Nov. 11, 2011

(87) PCT Pub. No.: WO2010/131834

PCT Pub. Date: Nov. 18, 2010

(65) Prior Publication Data

US 2012/0047858 A1 Mar. 1, 2012

(30) Foreign Application Priority Data

May 11, 2009 (KR) ..... 10-2009-0040573

(51) Int. Cl.
*B01D 59/00* (2006.01)

(52) U.S. Cl.
USPC ..... 55/429; 55/432; 55/433; 55/502; 55/DIG. 3

(58) Field of Classification Search
USPC ..... 55/429, 432, 433, DIG. 3, 502
See application file for complete search history.

(56) References Cited

U.S. PATENT DOCUMENTS

2005/0229355 A1* 10/2005 Crouch et al. ..... 15/352

OTHER PUBLICATIONS

International Search Report, mailed Oct. 11, 2010, in International Application No. PCT/KR2010/000804 (3 pp.).

* cited by examiner

*Primary Examiner* — Dung H Bui
(74) *Attorney, Agent, or Firm* — Staas & Halsey LLP

(57) ABSTRACT

Disclosed is a dust-collecting apparatus with a packing member. The disclosed dust-collecting apparatus for separating dust from introduced air comprises: a dust-collecting receptacle with an open bottom; a dust discharge cover arranged at the bottom of the dust-collecting receptacle such that that the dust discharge cover can be opened/closed; and a packing member for sealing the dust-collecting receptacle and the dust discharge cover, wherein the packing member presses the dust discharge cover in the direction of opening the dust discharge cover. Thus, the dust discharge cover can be opened from the bottom of the dust-collecting receptacle in an easier manner.

12 Claims, 3 Drawing Sheets

DUST-COLLECTING APPARATUS WITH A PACKING MEMBER

This application is a U.S. National Stage Application of International Application No. PCT/KR2010/000804, filed Feb. 9, 2010, the disclosure of which is herein incorporated in its entirety by reference. The application claims priority to Korean Application No. 10-2009-0040573, filed May 11, 2009, the disclosure of which is herein incorporated in its entirety by reference.

TECHNICAL FIELD

The present invention relates to a dust collecting apparatus with a packing member, and more particularly to a dust collecting apparatus provided with a packing member so as to seal a dust collecting receptacle and a dust discharge cover.

BACKGROUND ART

In general, a vacuum cleaner is an apparatus which mounts a dust collecting apparatus utilizing a dust bag or a dust collecting receptacle at a cleaner body so as to collect dust from a surface to be cleaned.

In the dust collecting apparatus, when the dust collecting receptacle is filled with dust by use of the vacuum cleaner for a long time, a user separates the dust collecting receptacle from the dust collecting apparatus and then performs an operation of emptying dust in a suitable place. In this case, there is a way of emptying dust through an opened upper portion of the dust collecting receptacle or a way of emptying dust by opening a dust discharge cover mounted at a lower portion of the dust collecting receptacle in terms of emptying dust.

In particular, the dust collecting apparatus, which mounts the dust discharge cover at the lower portion of the dust collecting receptacle, is equipped with a packing member between the dust discharge cover and the lower portion of the dust collecting receptacle such that dust particles collected within the dust collecting receptacle may leak to the outside.

However, when the dust discharge cover is opened in order to empty dust from the dust collecting receptacle in this conventional dust collecting apparatus, the packing member leads to friction with an inner surface of the dust collecting receptacle, and thus the dust discharge cover is not easily opened. Consequently, since an additional configuration is provided in order to move the dust discharge cover in a downward direction, there are problems which cause a complicated configuration and increase in manufacturing costs.

In addition, in the case of the conventional dust collecting apparatus, an amount of dust collected in the dust collecting receptacle is increased, and thus deformation to allow the dust discharge cover to be spaced apart from the dust collecting receptacle may be generated by weight of the increased dust. Consequently, since the packing member does not properly function as sealing, there is a problem in that dust particles collected in the dust collecting receptacle leak to the outside.

DISCLOSURE

Technical Problem

Therefore, the present invention has been made in view of the above problems, and it is an object of the present invention to provide an improved dust collecting apparatus capable of easily opening and closing a dust discharge cover when the dust discharge cover of a dust collecting receptacle with a packing member is opened to empty dust therefrom.

Also, it is another object of the present invention to provide a dust collecting apparatus with a packing member having high sealing performance between a dust collecting receptacle and a dust discharge cover.

Technical Solution

In accordance with an aspect of the present invention, the above and other objects can be accomplished by the provision of a dust collecting apparatus to separate dust from introduced air including a dust collecting receptacle which is opened at a lower portion thereof, a dust discharge cover mounted at the lower portion of the dust collecting receptacle so as to allow opening and closing thereof, and a packing member to seal the dust collecting receptacle and the dust discharge cover, wherein the packing member presses the dust discharge cover in a direction of opening the dust discharge cover.

The packing member may include a first sealing portion which extends from an end of the dust collecting receptacle to an inner portion of the dust collecting receptacle, and the first sealing portion may be mounted so as to cover a portion of an inner surface of the dust discharge cover from an upper surface of an edge portion of the dust discharge cover.

The dust collecting receptacle may be formed at an end thereof with a coupling groove, and the packing member may further include a coupling portion coupled to the coupling groove.

The packing member may further include a second sealing portion formed to slant downwards toward an outer side with respect to the coupling portion.

The packing member may be formed with a stepped portion provided between the first sealing portion and a second sealing portion.

The dust discharge cover may be pivoted along a hinge shaft so as to selectively open and close the lower portion of the dust collecting receptacle.

The packing member may have a ring shape while being formed so that a portion thereof has a rectilinear section in the vicinity of the hinge shaft.

The packing member may further come into close contact with an inner surface of the dust discharge cover as an amount of dust collected within the dust collecting receptacle increases, thereby more strongly pressing the dust discharge cover to an opening position.

A safety space may be formed between the packing member and an inner surface of the dust discharge cover.

Advantageous Effects

In accordance with the present invention, when a dust discharge cover opens a lower portion of a dust collecting receptacle, a packing member does not generate friction force in a direction of opening the dust discharge cover, thereby allowing opening and closing of the dust discharge cover by gravity. Consequently, a separate configuration to push the dust discharge cover is not required, thereby providing a simple structure and reducing the number of parts.

Also, in accordance with the present invention, since a packing member presses in a direction of opening a dust discharge cover, the dust discharge cover may be easily opened. Consequently, a separate configuration to push the dust discharge cover is not required, thereby providing a simple structure and reducing the number of parts.

Furthermore, in accordance with the present invention, although a dust discharge cover is deformed by weight of dust collected in a dust collecting receptacle, a packing member includes first and second sealing portions so as to maintain sealing, thereby improving sealing performance between the dust collecting receptacle and the dust discharge cover.

DESCRIPTION OF DRAWINGS

The above and other objects, features and other advantages of the present invention will be more clearly understood from the following detailed description taken in conjunction with the accompanying drawings, in which.

BEST MODE

Figure 1:
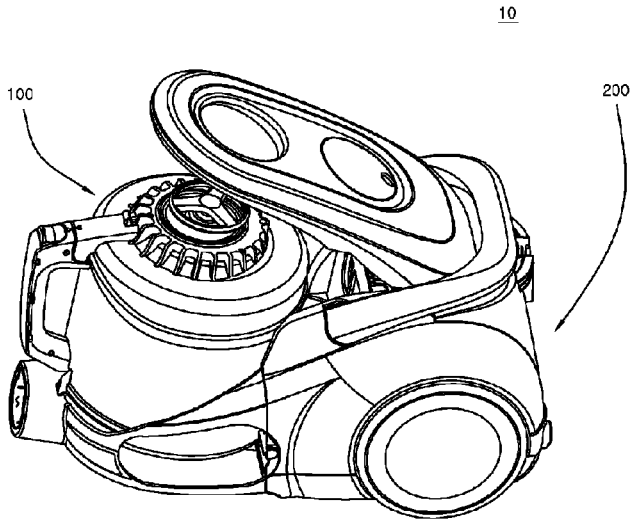
FIG. 1 is a perspective view illustrating a state in which a dust collecting apparatus with a packing member according to an embodiment of the present invention is seated in a cleaner body 200.
Figure 2:
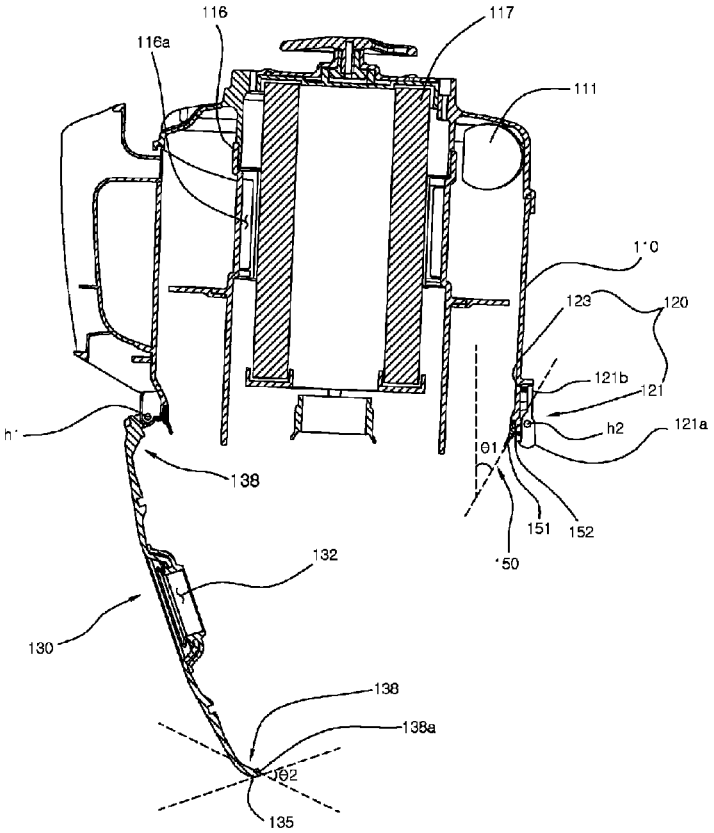
FIG. 2 is a sectional view illustrating the dust collecting apparatus in which a dust discharge cover is opened.
Figure 3:
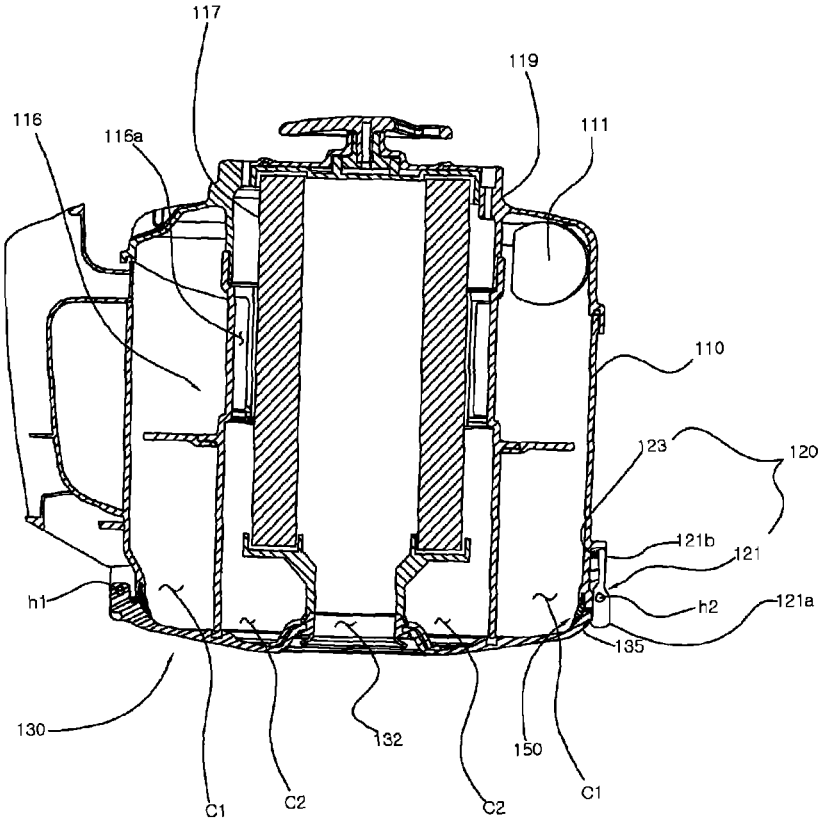
FIG. 3 is a sectional view illustrating the dust collecting apparatus in which the dust discharge cover is closed.

Hereinafter, a dust collecting apparatus 100 with a packing member according to an embodiment of the present invention will be described in detail with reference to the drawings. FIG. 1 is a perspective view illustrating a state in which the dust collecting apparatus 100 with the packing member according to the embodiment of the present invention is seated in a cleaner body 200. FIG. 2 is a sectional view illustrating the dust collecting apparatus in which a dust discharge cover is opened. FIG. 3 is a sectional view illustrating the dust collecting apparatus in which the dust discharge cover is closed.

The present invention is characterized by the packing member 150 mounted between the dust collecting receptacle 110 and the dust discharge cover 130. Accordingly, a structure for separation of dust will be briefly described.

Referring to FIG. 1, the dust collecting apparatus 100 according to the present embodiment is used in a state of being mounted at the cleaner body 200. The cleaner body 200 is equipped with a suction motor (not shown). A cleaning operation is performed in such a manner that outdoor air is guided to the dust collecting apparatus 100 by suction force of the suction motor (not shown) so as to collect dust, and then air which is purified is discharged to the outside.

In the dust collecting apparatus 100 with the packing member according to the present embodiment, a suction port 111 is formed at an upper cover 119 in a tangential direction in order to introduce outdoor air, as shown in FIGS. 2 and 3. The upper cover 119 is coupled at a lower side thereof with the dust collecting receptacle 110, and the dust collecting receptacle 110 is installed with a grill member 116 therein. The grill member 116 has a cylindrical shape while being formed on a circumference thereof with a plurality of discharge holes 116*a*. The grill member 116 is installed with a filter member 117 having a cylindrical shape therein. The dust collecting receptacle 110 is mounted at a lower portion thereof with the dust discharge cover 130, and the dust discharge cover 130 is formed at central area thereof with an outlet hole 132 which communicates with an interior of the filter member 117. Outdoor air is introduced into the dust collecting receptacle 110 through the suction port 111 to generate a rotational air current. Then, dust contained in the outdoor air is centrifuged by the rotational air current to fall onto a bottom of the dust collecting receptacle 110, thereby being collected in a first dust collecting chamber C1 which is formed between the dust discharge cover 130 and the dust collecting receptacle 110. After dust is primarily separated from air, fine dust is secondarily separated from the air which passes through the grill member 116 and the filter member 117 having the cylindrical shape. Consequently, the fine dust is collected in a second dust collecting chamber C2 formed between the dust discharge cover 130 and the grill member 116. Thereafter, the purified air introduced into the filter member 117 moves to a lower side of the filter member 117 so as to move out of the dust collecting apparatus 100 through the outlet hole 132 formed at the central area of the dust discharge cover 130, and is then discharged to the outside of the cleaner body 200 via the suction motor (not shown).

Meanwhile, in order to empty dust collected in the dust collecting receptacle 110 of the dust collecting apparatus 100 with the packing member according to the present embodiment, the dust discharge cover 130 is pivotally mounted at the dust collecting receptacle 110 by a hinge shaft h1 so as to selectively open the lower portion of the dust collecting receptacle 110. A locking means 120 to selectively lock the dust discharge cover 130 is mounted at an opposite side of the hinge shaft h1 in the dust collecting receptacle 110.

The locking means 120 includes a hook member 121 and an elastic member 123. The hook member 121 is pivotally mounted by a hinge shaft h2 formed at a side surface of the dust collecting receptacle 110. The elastic member 123 serves as a coil spring, and is mounted between the hook member 121 and the dust collecting receptacle 110 so that an engagement protrusion 121*a* of the hook member 121 is elastically pressed to an engagement groove 135 formed at the dust discharge cover 130. When a user opens the dust discharge cover 130 in a direction of opening the lower portion of the dust collecting receptacle 110 in order to empty dust collected in the dust collecting receptacle 110, a user pushes a button portion 121*b* of the hook member 121 so as to release the engagement protrusion 121*a* from the engagement groove 135. Consequently, the dust discharge cover 130 is pivoted by gravity, as shown in FIG. 2 so that dust collected in the dust collecting receptacle 110 is discharged to the outside, thereby enabling the dust in the dust collecting receptacle 110 to be emptied.

Although the present embodiment describes a configuration in which the locking means 120 is mounted at the side surface of the dust collecting receptacle 110, the locking means may also be mounted within the dust collecting receptacle 110 if the locking means selectively locks the dust discharge cover 130. In this case, although not shown, the present embodiment may apply a configuration in which the dust discharge cover is formed with an engagement hook therein, and the upper cover of the dust collecting apparatus is installed with a button member to interlock the hook member selectively coupled with the engagement hook so as to open and close the dust discharge cover by an operation of pushing the button member.

Hereinafter, the packing member 150 mounted between the dust collecting receptacle 110 and the dust discharge cover 130 according to the present invention will be described in detail.

Referring to FIG. 2, the dust collecting receptacle 110 has a cylindrical shape opened at the lower portion thereof while being formed at an end of a lower edge thereof with a coupling groove 110*a*. The dust discharge cover 130 is formed at the central area with the outlet hole 132 having a predetermined diameter. Also, the dust discharge cover 130 has a concave shape recessed at the central area thereof while having a shape curved upwards as the dust discharge cover 130 approaches an upper side of an edge portion 138.

Referring to FIG. 3, the packing member 150 is mounted between the dust collecting receptacle 110 and the dust discharge cover 130 in order to prevent dust collected in the dust collecting receptacle 110 from leaking to the outside in a state in which the lower portion of the dust collecting receptacle 110 is closed by the dust discharge cover 130.

Figure 4:
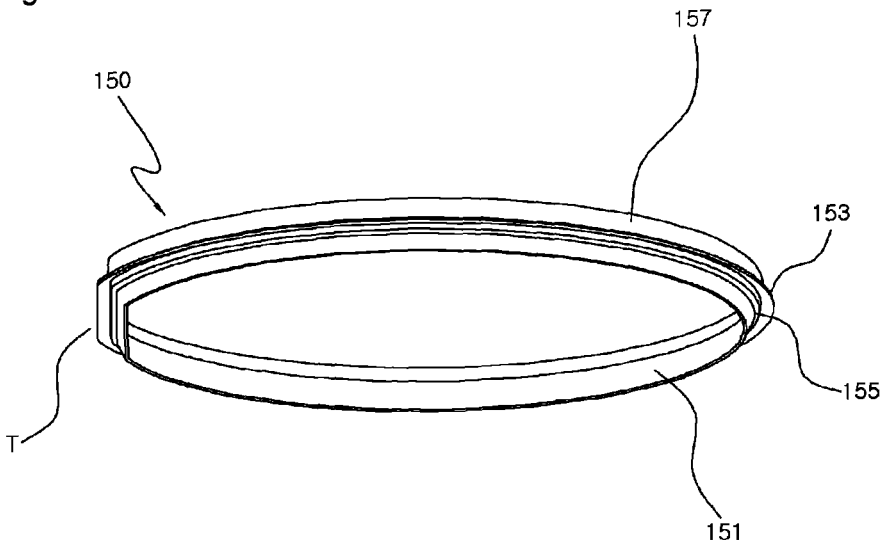
FIG. 4 is a perspective view illustrating the packing member according to the embodiment of the present invention.

Referring to FIG. 4, the packing member generally has a ring shape, but a portion thereof has a rectilinear section in the vicinity of the hinge shaft h1 to which the dust discharge cover 130 and the dust collecting receptacle 110 are pivotally coupled. The packing member 150 is coupled to a lower side of the dust collecting receptacle 110. The packing member 150 is inserted into the coupling groove 110*a* of the dust collecting receptacle 110 so as to be provided with a coupling portion 157 coupled to the coupling groove 110*a*.

Figure 5:
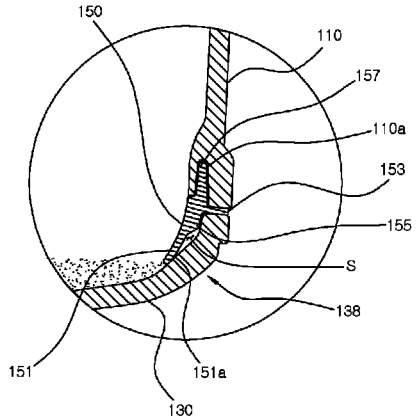
FIG. 5 is an enlarged sectional view illustrating a state of the packing member when an amount of dust collected in a dust collecting receptacle is small.
Figure 6:
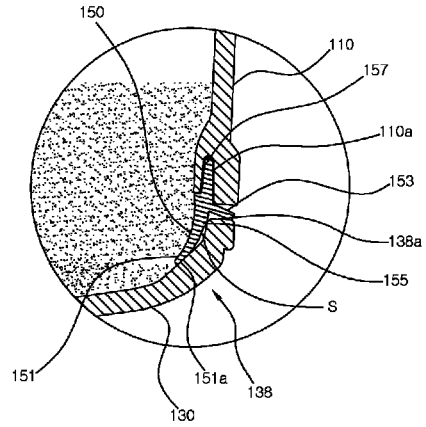
FIG. 6 is an enlarged sectional view illustrating a state of the packing member when an amount of dust collected in the dust collecting receptacle is large.

Referring to FIGS. 4 to 6, the packing member 150 is formed with a first sealing portion 151 which slantingly extends downwards toward an inner side with respect to the coupling portion 157. The first sealing portion 151 is formed at a portion thereof to overlap with the dust discharge cover 130 in the state of closing the lower portion of the dust collecting receptacle 110 by the dust discharge cover 130. That is, the first sealing portion 151 is mounted to extend toward an inner side from a lower end of the dust collecting receptacle 110, thereby covering a portion of an inner surface of the edge portion 138 from an upper surface 138*a* of the edge portion of the dust discharge cover 130.

Referring to FIG. 2, when a slope between the first sealing portion 151 and a vertical line is represented by e1, and a slope between the inner surface of the edge portion 138 of the dust discharge cover 130 and the vertical line is represented by e2 in the state of closing the lower portion of the dust collecting receptacle 110 by the dust discharge cover 130, e1 is less than e2.

In this case, since e1<e2, when the dust discharge cover 130 closes the opened lower portion of the dust collecting receptacle 110 by using the locking means 120, the first sealing portion 151 is deformed to press the dust discharge cover 130 in a direction of opening the same, thereby coming into contact with the inner surface of the edge portion 138 of the dust discharge cover 130.

When dust is gradually increased in weight in proportion to dust collected in the dust collecting receptacle 110, the first sealing portion 151 is deformed to more strongly press the dust discharge cover 130 in the direction of opening the same due to the weight of the collected dust, thereby greatly increasing a contact area with the inner surface of the edge portion 138 of the dust discharge cover 130, as shown in FIG. 6.

Accordingly, since the first sealing portion 151 comes into contact with the inner surface of the edge portion 138 of the dust discharge cover 130 regardless of an amount of dust collected in the dust collecting receptacle 110, dust particles collected in the dust collecting receptacle 110 do not leak to the outside.

An amount of dust collected in the dust collecting receptacle 110 is increased, and thus deformation to allow the dust discharge cover 130 to be spaced apart from the dust collecting receptacle 110 may be generated by the weight of the increased dust. However, even when such a case is encountered, the first sealing portion 151 is formed to partially overlap with the dust discharge cover 130 while pressing the dust discharge cover 130 in the direction of opening the same, and thus contact between the dust discharge cover 130 and the first sealing portion 151 is maintained and is sealed therebetween. As a result, it may be possible to prevent dust particles collected in the dust collecting receptacle 110 from leaking to the outside.

Meanwhile, the first sealing portion 151 is formed to slant downwards toward the inner side with respect to the coupling portion 157, whereas the dust discharge cover 130 is formed in the vicinity of the edge thereof to slant upwards. Therefore, when the dust discharge cover 130 is opened to empty dust therefrom, no friction force is generated between the first sealing portion 151 and the dust discharge cover 130. As a result, the dust discharge cover 130 may be opened and closed by gravity. In addition, the first sealing portion 151 presses the dust discharge cover 130 in the direction of opening the same. Consequently, as soon as the engagement protrusion 121*a* of the locking means 120 is released from the engagement groove 135 of the dust discharge cover 130, the first sealing portion 151 pushes the dust discharge cover 130, thereby greatly facilitating the opening of the dust discharge cover 130.

The packing member 150 is formed with a second sealing portion 153 which slantingly extends downwards toward an outer side with respect to the coupling portion 157. In this case, as shown in FIG. 5, when a small amount of dust is collected in the dust collecting receptacle 110, the second sealing portion 153 is deformed to be perpendicular to the coupling portion 157 by being coupled with the locking means 120 in the state of closing the lower portion of the dust collecting receptacle 110 by the dust discharge cover 130. Consequently, the second sealing portion 153 comes into face contact with the upper surface 138*a* of the edge portion of the dust discharge cover 130.

Also, as shown in FIG. 6, when deformation to allow the dust discharge cover 130 to be spaced apart from the dust collecting receptacle 110 is generated due to a large amount of dust collected in the dust collecting receptacle 110, the second sealing portion 153 is restored in an original state so as to slant downwards toward the outer side with respect to the coupling portion 157. Consequently, the second sealing portion 153 comes into linear contact with the dust discharge cover 130. That is, even when deformation to allow the dust discharge cover 130 to be spaced apart from the dust collecting receptacle 110 is generated due to a large amount of dust being filled in the dust collecting receptacle 110, contact between the second sealing portion 153 and the dust discharge cover 130 is maintained, thereby enabling the second sealing portion 153 of the packing member 150 to prevent dust particles collected in the dust collecting receptacle 110 from leaking to the outside.

Meanwhile, when the dust discharge cover 130 closes the lower portion of the dust collecting receptacle 110 so that the first sealing portion 151 comes into contact with the dust discharge cover 130 and the second sealing portion 153 comes into contact with the upper surface 138*a* of the edge portion of the dust discharge cover 130, a safety space S is formed between the packing member 150 and the inner surface of the dust discharge cover 130.

In this case, in the state of closing the dust discharge cover 130, the first sealing portion 151 is deformed to more strongly press the dust discharge cover 130 in the direction of opening the same in proportion to the increased amount of dust collected in the dust collecting receptacle 110. Consequently, the safety space S is gradually reduced in area.

The packing member 150 is formed with a stepped portion 155 provided between the first and second sealing portions 151 and 153 in order to reinforce the first and second sealing portions 151 and 153. The first sealing portion 151 is too damaged to perform a role, such that dust may be introduced into the safety space S. However, although such a case is encountered, dust is blocked by the stepped portion 155, thereby preventing dust particles from leaking to the outside of the dust collecting apparatus.

Hereinafter, a sealing operation of the packing member 150 according to the present embodiment will be described.

When no dust is collected in the dust collecting receptacle 110 or a little dust is collected in the first and second dust collecting chambers C1 and C2 formed within the dust collecting receptacle 110 as shown in FIG. 5, deformation to allow the dust discharge cover 130 to be spaced apart from the dust collecting receptacle 110 is not generated by the weight of the dust. In this case, the first sealing portion 151 partially overlaps with the inner surface of the edge portion 138 of the dust discharge cover 130 while being deformed to press the dust discharge cover 130 in the direction of opening the same. Consequently, the first sealing portion 151 comes into contact with the inner surface of the edge portion 138 of the dust discharge cover 130. On the other hand, the second sealing portion 153 is deformed upwards so as to press the upper surface 138*a* of the edge portion of the dust discharge cover 130, thereby coming into face contact with the upper surface 138*a*. Therefore, dust particles within the dust collecting receptacle 110 do not leak to the outside.

Meanwhile, when deformation to allow the dust discharge cover 130 to be spaced apart from the dust collecting receptacle 110 is generated by the weight of a large amount of dust collected in the first and second dust collecting chambers C1 and C2 as shown in FIG. 6, the first sealing portion is moved to the dust discharge cover 130 side by the weight of the dust. In this case, a contact area between an end 151*a* of the first sealing portion 151 and the dust discharge cover 130 is larger than that between the end 151*a* of the first sealing portion 151 and the dust discharge cover 130 shown in FIG. 5, thereby achieving more secure sealing. Furthermore, the second sealing portion 153 is restored so as to slant downwards toward the outer side with respect to the coupling portion 157. Consequently, the second sealing portion 153 comes into linear contact with the upper surface 138*a* of the edge portion of the dust discharge cover 130, thereby preventing dust particles collected in the first dust collecting chamber C1 from leaking to the outside (see FIG. 6).

Thereafter, when the first and second dust collecting chambers C1 and C2 are filled with dust and then an operation of emptying dust is performed, a user pushes the button portion 121*b* of the locking means 120 so as to release the engagement protrusion 121*a* from the engagement groove 135 of the dust discharge cover 130. When the engagement protrusion 121*a* is released, the dust discharge cover 130 is pivoted by gravity and the first sealing portion 151. Consequently, the lower portion of the dust collecting receptacle 110 is opened to discharge dust.

In this case, the first sealing portion 151 is formed to slant downwards toward the inner side with respect to the coupling portion 157. Therefore, when the dust discharge cover 130 is opened, no friction force is generated between the first sealing portion 151 and the dust discharge cover 130. Accordingly, when the button portion 121*b* of the locking means 120 is pushed, the engagement protrusion 121*a* is released from the engagement groove 135 so as to allow the dust discharge cover 130 to be opened by gravity. In addition, since the first sealing portion 151 presses the dust discharge cover 130 to open the same, the dust discharge cover 130 is pivoted by the pressed force of the first sealing portion 151 as soon as the engagement protrusion 121*a* is released from the engagement groove 135, thereby greatly facilitating the opening of the dust discharge cover 130.

In the present invention as described above, when the dust discharge cover 130 is opened, the dust discharge cover 130 does not encounter friction with the first sealing portion 151, compared with the conventional dust collecting apparatus. Consequently, a separate configuration to push the dust discharge cover 130 is not required besides the locking means 120, thereby providing a simple structure and reducing manufacturing costs. In addition, since the first sealing portion 151 presses the dust discharge cover 130, the dust discharge cover 130 may be easily opened.

Furthermore, in the case of the packing member 150 according to the present embodiment, although deformation of the dust discharge cover 130 is generated by the weight of a large amount of dust collected in the dust collecting receptacle 110, the first and second sealing portions 151 and 153 maintain contact with the dust discharge cover 130. As a result, it may be possible to prevent dust particles collected in the dust collecting receptacle 110 from leaking.

Various embodiments have been described in the best mode for carrying out the invention.

[Industrial Applicability]

The dust collecting apparatus with the packing member according to the present invention may be applied to cleaning apparatuses such as domestic, business, and industrial vacuum cleaners and robot cleaners.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A dust collecting apparatus to separate dust from introduced air comprising:

a dust collecting receptacle which is opened at a lower portion thereof;

a dust discharge cover mounted at the lower portion of the dust collecting receptacle so as to allow opening and closing thereof; and a packing member to seal the dust collecting receptacle and the dust discharge cover, wherein the packing member exerts pressure on the dust discharge cover in a direction of opening the dust discharge cover at all points of contact between the packing member and the dust discharge cover.

2. The dust collecting apparatus according to claim 1, wherein:

the packing member comprises a first sealing portion which extends from an end of the dust collecting receptacle to an inner portion of the dust collecting receptacle; and the first sealing portion is mounted so as to cover a portion of an inner surface of the dust discharge cover from an upper surface of an edge portion of the dust discharge cover.

3. The dust collecting apparatus according to claim 2, wherein:

the dust collecting receptacle is formed at an end thereof with a coupling groove; and the packing member further comprises a coupling portion coupled to the coupling groove.

4. The dust collecting apparatus according to claim 3, wherein the packing member further comprises a second sealing portion formed to slant downwards toward an outer side with respect to the coupling portion.

5. The dust collecting apparatus according to claim 3, wherein the packing member is formed with a stepped portion provided between the first sealing portion and a second sealing portion.

6. The dust collecting apparatus according to claim 1, wherein the dust discharge cover is pivoted along a hinge shaft so as to selectively open and close the lower portion of the dust collecting receptacle.

7. The dust collecting apparatus according to claim 6, wherein the packing member has a ring shape while being formed so that a portion thereof has a rectilinear section in the vicinity of the hinge shaft.

8. The dust collecting apparatus according to claim 1, wherein the packing member comes into greater contact with an inner surface of the dust discharge cover as the amount of dust collected within the dust collecting receptacle increases, thereby exerting greater pressure on the dust discharge cover to an opening position.

9. The dust collecting apparatus according to claim 1, wherein a safety space is formed between the packing member and an inner surface of the dust discharge cover.

10. A dust collecting apparatus to separate dust from introduced air comprising:

a dust collecting receptacle which is opened at a lower portion thereof;

a dust discharge cover mounted at the lower portion of the dust collecting receptacle so as to allow opening and closing thereof; and a packing member to seal the dust collecting receptacle and the dust discharge cover, wherein no friction force to disturb opening of the dust discharge cover occurs between the packing member and the dust discharge cover, during opening of the dust collecting receptacle.

11. A dust collecting apparatus to separate dust from introduced air comprising:

a dust collecting receptacle which is opened at a lower portion thereof;

a dust discharge cover mounted at the lower portion of the dust collecting receptacle so as to allow opening and closing thereof; and a packing member to seal the dust collecting receptacle and the dust discharge cover, wherein the packing member exerts pressure on the dust discharge cover in a direction of opening the dust discharge cover at all points of contact between the packing member and the dust discharge cover, wherein the packing member comes into greater contact with an inner surface of the dust discharge cover as the amount of dust collected within the dust collecting receptacle increases, thereby exerting greater pressure on the dust discharge cover to an opening position.

12. A dust collecting apparatus to separate dust from introduced air comprising:

a dust collecting receptacle which is opened at a lower portion thereof;

a dust discharge cover mounted at the lower portion of the dust collecting receptacle so as to allow opening and closing thereof; and a packing member to seal the dust collecting receptacle and the dust discharge cover, wherein the packing member exerts pressure on the dust discharge cover in a direction of opening the dust discharge cover at all points of contact between the packing member and the dust discharge cover, wherein a safety space is formed between the packing member and an inner surface of the dust discharge cover.

* * * * *

UNITED STATES PATENT AND TRADEMARK OFFICE

CERTIFICATE OF CORRECTION

PATENT NO. : 8,728,188 B2
APPLICATION NO. : 13/320061
DATED : May 20, 2014
INVENTOR(S) : Tak Soo Kim et al.

It is certified that error appears in the above-identified patent and that said Letters Patent is hereby corrected as shown below:

On the Title Page

Column 2, Item [57] (Abstract), Line 5, Delete "that that" and insert -- that --, therefor.

Signed and Sealed this
Fourth Day of November, 2014

Michelle K. Lee

Michelle K. Lee
*Deputy Director of the United States Patent and Trademark Office*